US008495785B2

(12) United States Patent
Triulzi

(10) Patent No.: US 8,495,785 B2
(45) Date of Patent: Jul. 30, 2013

(54) ADVANCED CLEANING TOOL

(75) Inventor: Paul Eugene Triulzi, Durham, NC (US)

(73) Assignee: Paul Eugene Triulzi, Durham, NC (US)

( * ) Notice: Subject to any disclaimer, the term of this patent is extended or adjusted under 35 U.S.C. 154(b) by 754 days.

(21) Appl. No.: 12/618,116

(22) Filed: Nov. 13, 2009

(65) Prior Publication Data

US 2010/0116291 A1 May 13, 2010

Related U.S. Application Data

(60) Provisional application No. 61/199,087, filed on Nov. 13, 2008.

(51) Int. Cl.
*A46B 15/00* (2006.01)

(52) U.S. Cl.
USPC ..... 15/114; 15/115; 15/169

(58) Field of Classification Search
USPC ..... 15/114, 115, 118, 244.1, 105, 110, 15/172, 201, 244.3, 160, DIG. 5, 168, 169; 132/120, 123
See application file for complete search history.

(56) References Cited

U.S. PATENT DOCUMENTS

| | | | | |
|---|---|---|---|---|
| 2,679,063 | A * | 5/1954 | Hoffmann | 15/186 |
| 2,819,482 | A * | 1/1958 | Applegate | 15/110 |
| 3,641,610 | A * | 2/1972 | Lewis, Jr. | 15/114 |
| 4,001,910 | A * | 1/1977 | Peilet | 15/184 |
| D350,232 | S | 9/1994 | Stangarone | |
| 6,675,812 | B1 | 1/2004 | Wiley | |
| 2002/0002984 | A1 | 1/2002 | Loy | |
| 2007/0180637 | A1 * | 8/2007 | McKay | 15/22.1 |
| 2008/0098550 | A1 | 5/2008 | McKay | |
| 2008/0178823 | A1 | 7/2008 | Hurwitz | |

FOREIGN PATENT DOCUMENTS

JP 2008279021 A * 11/2008

OTHER PUBLICATIONS

JP2008279021A (machine translation).*

* cited by examiner

*Primary Examiner* — Mark Spisich
*Assistant Examiner* — Andrew A Horton
(74) *Attorney, Agent, or Firm* — Andrew D. Gerschutz; Moore & Van Allen, PLLC

(57) ABSTRACT

/A cleaning tool including a first support member, an absorbent member disposed below the first support member; and a plurality of brush bristles which extend into the absorbent member. Further embodiments of the present invention provide a cleaning tool including a first support member and a second support member, an absorbent member disposed below the second support member, an elastic compressible substrate sandwiched between the first support member and the second support member; a plurality of brush bristles which extend into the absorbent member; and an adjusting mechanism for varying the position of the second support member relative to the first support member, such that the cleaning tips of the brush bristles can be inside, outside or coincident with the absorbent member.

13 Claims, 3 Drawing Sheets

ADVANCED CLEANING TOOL

This application claims priority to U.S. Provisional Application Ser. No. 61/199,087, filed Nov. 13, 2008, the contents of which are hereby incorporated in their entirety.

BACKGROUND ART

Many cleaning products are available in today's marketplace. However, some cleaning jobs require multiple tools for satisfactory completion of the cleaning job. In many cases, a brush is needed for applying a scrubbing action to a surface. It is often preferable to maintain a wet surface on the object being cleaned while applying the scrubbing action with the brush. However, it is not always easy to maintain a high level of moisture when using a brush as the cleaning tool, particularly when the scrubbed surface is vertical, above the scrubber, or is situated so that the scrubbing action must occur with the scrubber reaching up to the surface.

SUMMARY OF THE INVENTION

Embodiments of the present invention provide a cleaning tool comprising a first support member, an absorbent member; the upper surface of which is disposed below the first support member; and a plurality of brush bristles which extend into the absorbent member. In at least some embodiments, the roots of the brush bristles are embedded in the first support member. In at least some embodiments, the absorbent member is attached to the first support member. In some embodiments, the cleaning tool further comprises a handle attached to the first support member.

Some embodiments of the present invention provide a cleaning tool, comprising a first support member and a second support member, an absorbent member disposed below the second support member, an elastic compressible substrate sandwiched between the first support member and the second support member; a plurality of brush bristles which extend into the absorbent member; and an adjusting mechanism for adjusting the position of the second support member relative to the first support member, wherein the position of the cleaning tips of the brush bristles in relation to the absorbent member is varied by using the adjusting mechanism. In at least some embodiments, the roots of the brush bristles are embedded in the first support member. In at least some embodiments, the absorbent member is attached to the second support member. In at least some embodiments, the position of the cleaning tips of the brush bristles is adjusted to be inside, outside, or coincident with the absorbent member.

Some embodiments of the present invention provide a method of adjusting the length of brush bristles protruding from a cleaning tool, comprising: providing a cleaning tool, comprising a first support member and a second support member; an absorbent member disposed below the second support member; and a plurality of brush bristles which extend into the absorbent member; and an elastic compressible substrate sandwiched between the first support member and the second support member; providing an adjusting mechanism for adjusting the position of the second support member relative to the first support member; and employing the mechanism for adjusting the position of the second support member relative to the first support member.

At least some embodiments of the present invention provide an apparatus for adjusting the length of brush bristles protruding from a cleaning tool, comprising means for adjusting the position of a plurality of brush bristles extending into an absorbent member of a cleaning tool, wherein the adjusting occurs by changing a spacing between a first support member and a second support member; and means for holding the spacing constant. In at least some embodiments, the apparatus further comprises a compressible substrate sandwiched between the first support member and the second support member.

DETAILED DESCRIPTION

Figure 1:
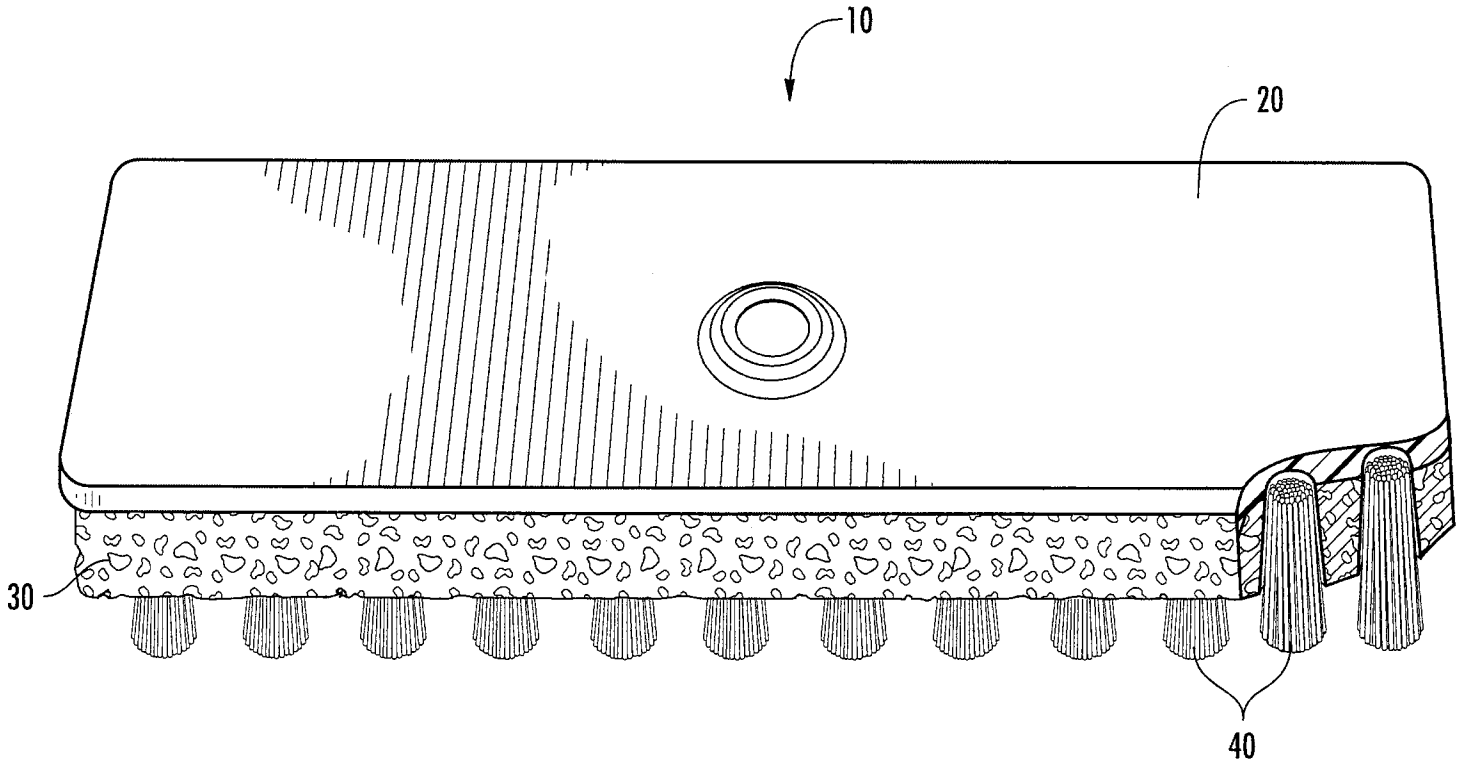
FIG. 1 depicts a top view of one embodiment of the invention.

The present invention will now be described in terms of specific, example embodiments. It is to be understood that the invention is not limited to the example embodiments disclosed. It should also be understood that not every feature of the methods described is necessary to implement the invention as claimed in any particular one of the appended claims. Various elements and features of various embodiments are described in order to fully enable the invention.

Embodiments of the present invention provide a cleaning tool, comprising a first support member; an absorbent member disposed below the first support member; and a plurality of brush bristles which extend into the absorbent member. In at least some embodiments, the roots of the brush bristles are embedded in the first support member. In at least some embodiments, the absorbent member is attached to the first support member. In some embodiments, the cleaning tool further comprises a handle attached to the first support member. In some embodiments, the handle is removably attached. The handle may be a pole of any length or may be of any other design. The type of handle is not meant to be limiting to the scope of the invention.

The support member may be made of any substance that could withstand use of the tool for cleaning. Examples of suitable materials include various metals, plastics, and rubbers, but any suitable materials may be used. Other examples of suitable materials include, but are not limited to, metal, fiberglass, epoxy, wood, wood composite, and powdered metal. In some embodiments, the support member will be made of a rigid material. In some embodiments, the support member will be made of a flexible material. The support material can have any desired shape, such as rectangular, oval, round, trapezoidal, or square.

The term "absorbent member", as used herein, refers to any material that has a liquid retention characteristic such that it is capable of absorbing liquid and of releasing the absorbed liquid when force is applied to the absorbent member. Examples of materials from which absorbent members can be constructed include sponges or other open-celled foams that easily absorb liquid and easily release liquid when flexed or compressed. The absorbent member may be made of any absorbent substance that would withstand use of the tool for cleaning and would provide a liquid retention characteristic during use of the cleaning tool. Examples of materials from which the absorbent member could be manufactured include, but are not limited to, open-celled foam, natural sponge, artificial sponge, microfiber or chamois. Different densities of materials can be used. One of skill in the art will understand that the cleaning tool will still fall within the scope of the invention with whichever absorbent material is used.

In at least some embodiments, the absorbent member provides a liquid retention characteristic which works in tandem with the brush bristles to maintain a wet environment for applying, in at least some embodiments, a simultaneous sponging and scrubbing action with the cleaning tool, and in some embodiments, just a scrubbing action or just a sponging action. In at least some embodiments, the mechanical movement of the brush bristles during brushing compresses the absorbent member, causing it to release liquid to the brush bristles while the device is being used. This can provide for the controlled use of chemicals in brushing applications, and can reduce the quantity of chemicals used and increase the efficiency of the work effort, thus providing financial and environmental benefits from using the cleaning tool.

The absorbent member may be bonded by an adhesive or otherwise physically attached to the support member, and the absorbent member surrounds the stems of the brush bristles. As used herein, the term "roots" of the brush bristles refers to the ends of the bristles that are used for attaching the bristles to the cleaning tool, as opposed to the cleaning tips of the bristles, which are used for the scrubbing action of the cleaning tool. The thickness of the absorbent member may vary. In some embodiments, the density of the absorbent material is sufficient to hold most liquids with only minor dripping of the liquid where there is not pressure being applied to the absorbent member, but sufficiently soft to allow liquid to be released easily under pressure.

In some embodiments, the absorbent member may be molded to the support member with brush bristles already in place by using, for example, a foaming manufacturing process that completely surrounds the brush bristle stems with the foam. In some embodiments, the absorbent member is attached to the support member first and then the brush bristles are added to the support member by inserting them through the sponge from the direction of the sponge surface or from the direction of the support member surface.

In some embodiments, the absorbent member is attached to the brush bristles first and then the brush bristles are attached to the support member such that the sponge is not physically attached to the support member but is bonded to the brush bristles. In some embodiments, the absorbent member does not fill the volume between the individual brush bristles in each brush bristle bundle, but does fill the volume in and around the bundles. In other words, in such embodiments the absorbent member is molded to encase each separate bundle of brush bristles before the bundle is attached to the support member. The absorbent member may be any desired shape, including, but not limited to, rectangular, oval, circular, L-shaped, U-shaped, W-shaped, or M-shaped.

The brush bristles may be made from any suitable material. One of skill in the art would understand that the materials from which the first support member, the absorbent member, and/or the brush bristles are made is not meant to be limiting to the scope of the invention, as such materials are well known to those of ordinary skill in the art. Examples of materials from which the bristles could be formed include, but are not limited to, metal, plastic, Tampico, straw, fiberglass, or any other flexible filament material. Any suitable materials could be used and still fall within the scope of the invention described herein. The bristles can be of varying length and thickness, depending on the prescribed application, and can be single filaments individually attached to the support member and/or bundles of filaments.

Embodiments of the present invention provide a cleaning tool, comprising a first support member and a second support member, an absorbent member disposed below the second support member, a compressible substrate sandwiched between the first support member and the second support member; a plurality of brush bristles which extend into the absorbent member; and an adjusting mechanism for adjusting the position of the second support member relative to the first support member, wherein the position of the cleaning tips of the brush bristles in relation to the absorbent member is adjusted by using the adjusting mechanism. In at least some embodiments, the roots of the brush bristles are embedded in the first support member. In at least some embodiments, the absorbent member is attached to the second support member.

The adjusting mechanism serves to change the distance that the cleaning tips of the brush bristles extend into and/or protrude beyond the bottom edge of the absorbent member. The change is accomplished by changing the distance between the first support member and the second support member, and then holding the spacing constant during use of the cleaning tool.

The distance that the cleaning tips of the brush bristles extend into and/or protrude beyond the bottom edge of the absorbent member is completely variable. In some embodiments, the brush bristles may extend into the absorbent member but the cleaning tips of the brush bristles may stay inside the absorbent member. In some embodiments, the brush bristles may extend into the absorbent member such that the cleaning tips are coincident with the bottom edge or surface of the absorbent member. In some embodiments, the brush bristles may extend into and through the absorbent member so that the cleaning tips of the brush bristles protrude from the absorbent member. In at least some embodiments, the distance of the protrusion is adjustable.

The elastic compressible substrate may be made of any substance that is both elastic and compressible, and serves to maintain the spacing between the first support member and the second support member. The elastic compressible substrate must expand when the spacing between the first support member and the second support member increases, and must contract when the spacing between the first support member and the second support member decreases. Examples of suitable substances for the elastic compressible substrate include, but are not limited to, springs made of various materials, closed or open-cell foams, rubberized foams or rubber compounds. In some embodiments, the material from which the elastic compressible substrate is made is identical to the material from which the absorbent member is made.

Examples of adjusting mechanisms include, but are not limited to, mechanisms that provide a continuum of adjustment positions, such as those comprising a screw and thread mechanism, and mechanisms that provide incremental preset adjustment positions, such as those comprising a pin and hole mechanism. Adjusting mechanisms are well known to those of ordinary skill in the art, and the type of adjusting mechanism used is not meant to limit the scope of the invention.

In some embodiments, the adjusting mechanism comprises a static and constant action. In one exemplary embodiment, the adjusting mechanism comprises a handle with a threaded feature attached through a threaded hole in the first support member and wherein the adjusting mechanism comprises a collar with a threaded feature, and wherein the handle is attached to the second support member such that rotating the cleaning tool around the handle results in an adjustment of the distance between the first support member and the second support member.

In another exemplary embodiment, the adjusting mechanism comprises a handle with a threaded feature passed through a smooth hole lacking threads in the first support member and attached to the second support member, wherein proximal to the first support member is a collar with a threaded feature such that rotating the collar around the handle results in an adjustment of the distance between the first support member and the second support member.

In still another exemplary embodiment, the adjusting mechanism comprises a pin and hole mechanism, wherein the handle comprises holes spaced in preset increments on the length of the handle, wherein a pin can be inserted into a hole to adjust the distance between the first support member and the second support member.

In still another exemplary embodiment, the adjusting mechanism comprises a friction locking mechanism attached to the first support member that impinges on the handle to lock it in place relative to the first support member, in order to adjust the distance between the first support member and the second support member.

In still another exemplary embodiment, the adjusting mechanism comprises a set of levers, one of which links directly, or indirectly, to the second support member, and one of which links to the handle, such that moving the lever linked to the handle changes the relative position of the second support member to the first support member, in order to adjust the distance between the first support member and the second support member.

In still another exemplary embodiment, the adjusting mechanism comprises a continuously variable and dynamic action such that the distance between the second support member and the first support member changes with the amount of pressure applied to the cleaning tool, and is not fixed at any particular position.

Some embodiments of the present invention provide a method of adjusting the length of brush bristles protruding from a cleaning tool, comprising: providing a cleaning tool, comprising a first support member and a second support member; an absorbent member disposed below the second support member; and a plurality of brush bristles which extend into the absorbent member; and a compressible substrate sandwiched between the first support member and the second support member; providing an adjusting mechanism for adjusting the position of the second support member relative to the first support member; and employing the mechanism to adjust the position of the second support member relative to the first support member.

At least some embodiments of the present invention provide an apparatus for adjusting the length of brush bristles protruding from a cleaning tool, comprising means for adjusting the position of a plurality of brush bristles extending into an absorbent member of a cleaning tool, wherein the adjusting occurs by changing a spacing between a first support member and a second support member; and means for holding the spacing constant. In at least some embodiments, the means for holding the spacing constant comprises a compressible substrate sandwiched between the first support member and the second support member.

With reference to the figures, the following description is based on an exemplary implementation of an embodiment of the invention. Reference numbers are used consistently throughout all of the figures. In FIG. 1, a cleaning tool 10 is depicted as viewed from the top. In the embodiment pictured in FIG. 1, the upper surface of the cleaning tool is a first support member 20. In at least some embodiments, the first support member is made from a plastic material, but other materials may be used. In some embodiments, the plastic is a rigid plastic. In some embodiments, the plastic is a flexible plastic.

An absorbent member 30 is positioned below the first support member 20. In at least some embodiments, the absorbent member is a sponge, but other materials may be used. Protruding from the absorbent member 30 are brush bristles 40. As shown in FIG. 1, the roots of the brush bristles 40 are embedded in and attached to the first support member 20. The brush bristles 40 extend into the absorbent member 30, with the cleaning tips of the brush bristles protruding from the absorbent member 30. The brush bristles may be made from any suitable material. One of skill in the art would understand that the material from which the first support member, the absorbent member, and/or the brush bristles are made is not meant to be limiting to the scope of the invention, as such materials are well known to those of ordinary skill in the art. Any suitable materials could be used and still be within the scope of the invention described herein.

Figure 2:
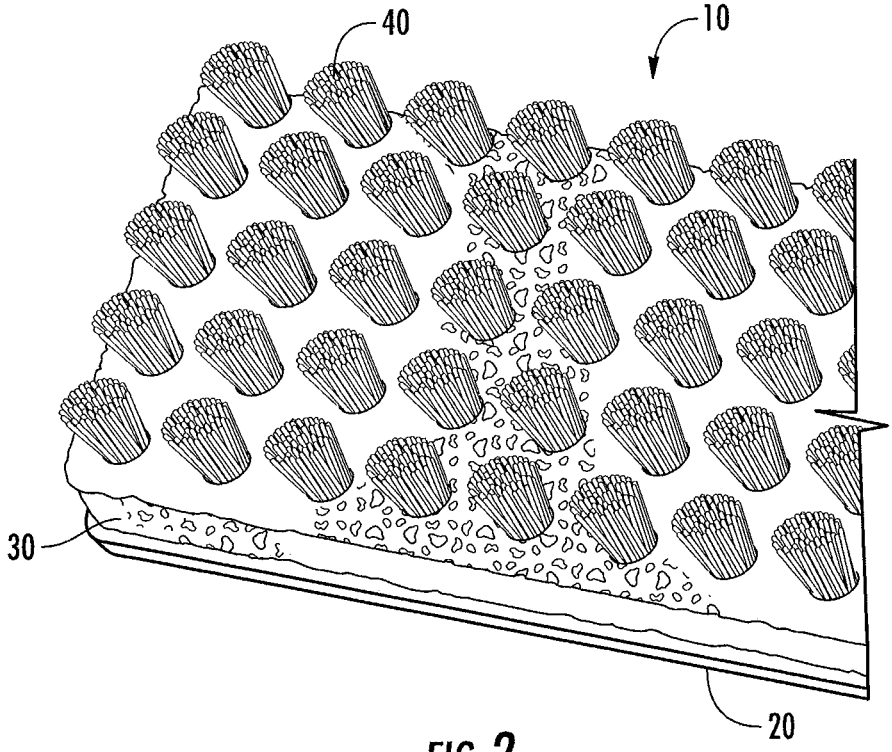
FIG. 2 depicts a bottom view of one embodiment of the invention.

FIG. 2 depicts an exemplary implementation of an embodiment of the cleaning tool viewed by looking at the bottom, relative to the top view shown in FIG. 1. In FIG. 2, the cleaning tool 10 is viewed as if turned upside down, with the brush bristles 40 protruding up. As depicted in FIG. 2, the first support member 20 is on the bottom, with the absorbent member 30 located above and the brush bristles 40 extending into the absorbent member 30.

Figure 3:
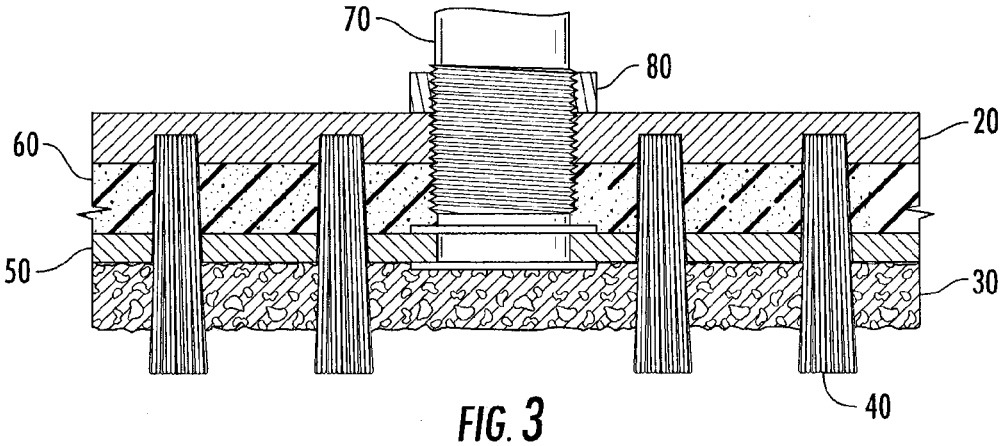
FIG. 3 depicts a partial cross section of one embodiment of the invention, wherein the embodiment includes a screw and thread adjusting mechanism.

FIG. 3 depicts an exemplary implementation of an embodiment of the invention viewed in partial cross section. The cleaning tool as embodied in FIG. 3 includes a handle 70 and an adjusting mechanism. The first support member 20, the absorbent member 30, and the brush bristles 40 are shown. Additionally, the cleaning tool of FIG. 3 comprises a second support member 50 and an elastic compressible substrate 60.

The cleaning tool of FIG. 3 further comprises a handle 70 with a threaded feature attached through a threaded hole in the first support member and wherein the adjusting mechanism comprises a collar 80 with a threaded feature, and wherein the handle 70 is attached to the second support member 50 such that rotating the cleaning tool around the handle results in an adjustment of the distance between the first support member 20 and the second support member 50.

The embodiment of the cleaning tool as depicted in FIG. 3 allows adjustment of the length of brush bristles 40 extending into and/or protruding from the bottom of the absorbent member 30. The first support member 20 comprises a collar 80 that serves to engage the handle 70. The threads of the handle 70 engage threads on the collar 80 and threads in the cavity of the cleaning tool that accepts the handle 70. Thus, the entire cleaning tool can be loosened or tightened to adjust the length of brush bristles 40 extending into and/or protruding from the bottom of the absorbent member 30.

Figure 4:
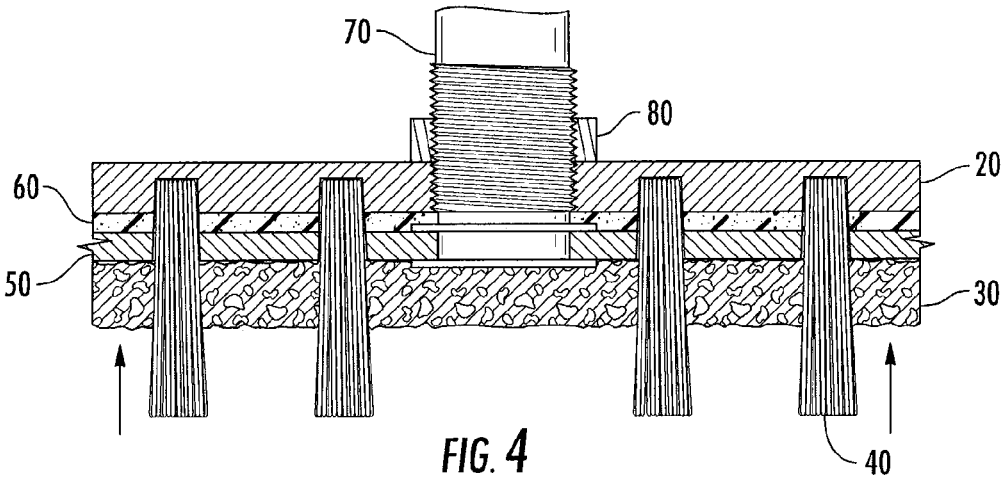
FIG. 4 depicts a partial cross section of the same embodiment of the invention as shown in FIG. 3, wherein the adjusting mechanism has been employed to increase the distance between the absorbent member and the cleaning tips of the brush bristles.

FIG. 4 depicts the embodiment as shown in FIG. 3, but wherein the adjusting mechanism has been further employed. The elastic compressible substrate 60 has been compressed in the direction shown by the two arrows by decreasing the distance between the first support member 20 and the second support member 50. The adjustment of the cleaning tool depicted in FIG. 4 results in a longer length of the brush bristles protruding from the bottom of the absorbent member 30 than the adjustment position depicted in FIG. 3.

Figure 5:
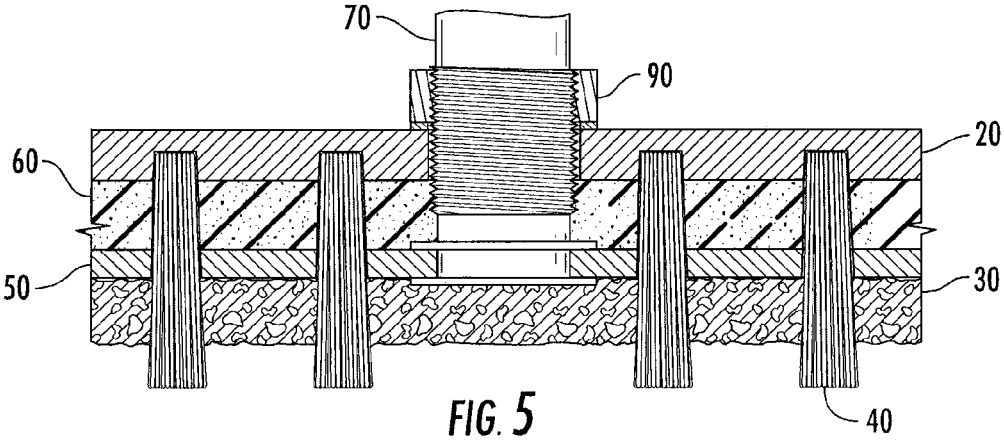
FIG. 5 depicts a partial cross section of one embodiment of the invention, wherein the embodiment includes a screw and thread adjusting mechanism, wherein a collar proximal to the first support member is screwed up or down to adjust the distance between the absorbent member and the cleaning tips of the brush bristles.

FIG. 5 depicts an exemplary implementation of an embodiment of the invention viewed in partial cross section. The cleaning tool of FIG. 5 shows an adjusting mechanism comprising a handle 70 with a threaded feature passing through a hole in the first support member 20 and attaching to the second support member 50, wherein proximal to the first support member is a collar 90 with a threaded feature such that rotating the collar 90 around the handle 70 results in an adjustment of the distance between the first support member 20 and the second support member 50.

The embodiment depicted in FIG. 5 allows adjustment of the length of brush bristles 40 extending into and/or protruding from the bottom of the absorbent member 30 by screwing only the collar 90 up or down. The threads of handle 70 are engaged only with the threads of collar 90. The cavity of the cleaning tool that accepts the handle 70 does not contain any threads. Thus, only the collar 90 is screwed onto the handle 70 in the embodiment of the screwing mechanism shown in FIG. 5, and the collar 90 is loosened or tightened to adjust the length of brush bristles 40 extending into and/or protruding from the bottom of the absorbent member 30.

Note that in the exemplary embodiments of the invention depicted in FIGS. 3, 4, and 5, the handle 70 is embedded in a cavity that extends into the interior of the cleaning tool. In some embodiments, the handle 70 is embedded and/or anchored in the second support member 50.

It should be pointed out that references may be made throughout this disclosure to figures and descriptions using terms such as "top", "bottom", "above", "beneath", "below", "on", "upper", "lower", and other terms which imply a relative position of a structure or portion. These terms are used merely for convenience and refer only to the relative position of features as shown from the perspective of the reader of this disclosure. An element that is placed or disposed atop another element in the context of this disclosure can be functionally in the same place in an actual product but be beside or below the other element relative to an observer due to the orientation of a device or equipment. Any discussions which use these terms are meant to encompass various possibilities for orientation and placement.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

What is claimed is:

1. A cleaning tool, comprising:

a. a first support member;

b. an absorbent member, an upper surface of which is disposed below the first support member; and c. a plurality of brush bristles which extend into the absorbent member;

d. a second support member, wherein the absorbent member is disposed below the second support member;

e. an elastic compressible substrate between the first support member and the second support member; and f. an adjusting mechanism for adjusting a position of the second support member relative to the first support member, whereby the position of cleaning tips of the brush bristles relative to the absorbent member is varied by using the adjusting mechanism.

2. The cleaning tool of claim 1, wherein roots of the brush bristles are attached to the first support member.

3. The cleaning tool of claim 1, further comprising a handle attached to the first support member.

4. The cleaning tool of claim 1, wherein the cleaning tips of the brush bristles extend beyond a bottom edge of the absorbent member.

5. The cleaning tool of claim 1, wherein the absorbent member is attached to the second support member.

6. The cleaning tool of claim 1, wherein roots of the brush bristles are embedded in the first support member.

7. The cleaning tool of claim 1, wherein the position of the absorbent member allows the cleaning tips of the brush bristles to be inside, outside, or coincident with the absorbent member.

8. The cleaning tool of claim 1, further comprising a handle with a threaded feature attached through a threaded hole in the first support member and wherein the adjusting mechanism comprises a collar with a threaded feature, and wherein the handle is attached to the second support member such that rotating the cleaning tool around the handle results in an adjustment of a distance between the first support member and the second support member.

9. The cleaning tool of claim 1, wherein the adjusting mechanism comprises a handle with a threaded feature passed through a hole in the first support member and attached to the second support member, wherein proximal to the first support member is a collar with a threaded feature such that rotating the collar around the handle results in an adjustment of a distance between the first support member and the second support member.

10. A method of adjusting a length of brush bristles protruding from a cleaning tool, the method comprising:

a. providing a cleaning tool comprising:

i. a first support member and a second support member;

ii. an absorbent member disposed below the second support member;

iii. a plurality of brush bristles which extend into the absorbent member; and iv. an elastic compressible substrate between the first support member and the second support member;

b. providing an adjusting mechanism for adjusting a position of the second support member relative to the first support member, whereby the position of cleaning tips of the brush bristles relative to the absorbent member is varied by using the adjusting mechanism; and c. employing the adjusting mechanism to adjust the position of the second support member relative to the first support member.

11. The method of claim 10, wherein the adjusting mechanism provides a continuum of adjustment positions.

12. The method of claim 10, wherein the adjusting mechanism is a screw and thread mechanism.

13. An apparatus for adjusting a position of an absorbent member relative to brush bristles on a cleaning tool, the apparatus comprising:

a. a first support member attached to a plurality of brush bristles;

b. a second support member attached to an absorbent member, wherein the plurality of brush bristles extend into the absorbent member c. an elastic compressible substrate between the first support member and the second support member;

d. means for adjusting the absorbent member relative to the brush bristles, wherein the adjusting occurs by changing a spacing between the first support member and the second support member; and wherein the means for adjusting further includes means to fix the spacing between the first and second support members in a desired position.

* * * * *